US010182655B1

(12) United States Patent
Frankel et al.

(10) Patent No.: US 10,182,655 B1
(45) Date of Patent: Jan. 22, 2019

(54) UPWARD FOLDING CHAIR

(71) Applicant: Zenithen USA LLC, Upland, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA, LLC, Upland, CA (US)

( * ) Notice: Subject to any disclaimer, the term of this patent is extended or adjusted under 35 U.S.C. 154(b) by 0 days.

(21) Appl. No.: 15/729,693

(22) Filed: Oct. 11, 2017

(51) Int. Cl.
*A47C 4/28* (2006.01)
*A47C 4/04* (2006.01)

(52) U.S. Cl.
CPC ..... *A47C 4/286* (2013.01); *A47C 4/045* (2013.01); *A47C 4/283* (2013.01)

(58) Field of Classification Search
CPC ..... A47C 4/045; A47C 4/283; A47C 4/286
USPC ..... 297/16.1, 16.2, 42, 45–47
See application file for complete search history.

(56) References Cited

U.S. PATENT DOCUMENTS 7,404,601 B2 * 7/2008 Chen ..... A47C 4/44 297/16.1
8,282,509 B1 * 10/2012 Michaelson ..... A63B 69/36 273/400
9,532,652 B2 * 1/2017 Choi ..... A47C 4/286
2010/0164256 A1 * 7/2010 Salisbury ..... A47C 4/286 297/16.2

* cited by examiner

*Primary Examiner* — Syed A Islam
(74) *Attorney, Agent, or Firm* — Merek, Blackmon & Voorhees, LLC

(57) ABSTRACT

The chair is an upwardly folding chair. It includes an upholstered seat cushion, a seat, and supporting legs. The upholstered seat is hung on the seat. The seat is supported by supporting legs. The supporting leg consists of four facades. Each facade consists of a pair of two diagonal bars which are crossed and hinged together in the center. The facade on each side consists of the front-tilting diagonal and the rear-tilting diagonal bar in the diagonal bar pair, a connecting bar and a supporting bar. The front-tilting diagonal bar is hinged to the front of the seat, and the rear of the seat is supported by supporting bars which include a left half and a right half, with corresponding or symmetrical seat bars, and it is formed by joining the front folding leaf and the rear folding leaf.

8 Claims, 9 Drawing Sheets

UPWARD FOLDING CHAIR

BACKGROUND OF THE INVENTION

Field of the Invention

This invention is to the household product category. Specifically, it refers to a type of chair that folds upwardly, and the seat of this folding chair can be folded up symmetrically.

Technical Background

This folding chair is typically made with Oxford fabric and steel bars. It is similar to beach chairs and leisure chairs that are very popular among the public. It offers outstanding comfort for sitting and folds to a compact size when folded. It is especially suitable for outdoor activities when rest is desired. The chair structure comprises an upholstered seat cushion, a seat, and supporting legs. The upholstered seat is hung on the seat. The seat is supported by supporting legs. The supporting leg consists of four facades. Each facade consists of a set of two diagonal bars which are crossed and connected in the center. The diagonal bars of the front and rear facades are connected to the diagonal bars of the two adjacent facades. The two adjacent facades are symmetrical. The seat is supported by the supporting bars in the two adjacent facades to form the folding structure. Due to design flaws, the seat cannot be folded in a proper angle. As such, how to adjust the folding method of the seat has become a goal of this invention.

SUMMARY OF THE INVENTION

One goal of this invention is to provide a type of seat frame that comprises two halves, with corresponding or symmetrical seat bars, that are joined together through front folding or back folding. The seat may be folded upwardly from the front or back with the upholstered seat cushion is embedded within.

The technical proposal of this invention is achieved in part in the following manner:

The chair is a type of upward folding chair. It includes a seat cushion, a seat, and supporting legs.

The upholstered seat cushion is hung on the seat frame to support the human body.

The chair leg consists of four facades. Each facade consists of a set of two diagonal bars which are crossed and connected in the center. The diagonal bars of the front and rear facades are hinged to the diagonal bars of the two adjacent facades.

The invention may have one or more of the following features:

- The two adjacent facades of the supporting leg are symmetrical or at least correspond to each other, including the front-tilting diagonal bar and the rear-tilting diagonal bar in the diagonal bar pair, and the connecting and supporting bars.
- The top of the aforementioned front-tilted diagonal bar is hinged to the front of the seat. There is a slide housing on the bar below the hinged point.
- One end of the aforementioned connecting bar is hinged on the slide housing; the other end is hinged to the aforementioned rear-tilting diagonal bar.
- One end of the aforementioned supporting bar is hinged to the connecting bar and the other end to the rear of the seat frame. The supporting legs assume their positions when the chair is opened, and the top of the aforementioned rear-tilting diagonal bar rests on the supporting bar.
- The aforementioned seat consists of a left half and a right half, with corresponding or symmetrical seat bars, and it is formed by joining the front folding leaf and the rear folding leaf
- The aforementioned folding leaves have an upward-facing hinge groove on both ends. The seat bar is welded into that hinge groove so that the seat can only be folded upwardly.
- When the seat is being folded upwardly, the supporting legs also fold up. Finally, by tying the connecting strap 6 and the seat bar 21 together, the structure of the folding position is formed.

The aforementioned supporting legs may also be equipped with a stabilizing support mechanism.

The support mechanism refers to a knitted belt, both ends of which are secured to the upper ends of the two front-tilting diagonal bars.

There is a fixation post on the upper end of the aforementioned front-tilting diagonal bars. The knitted strap is affixed to this bar.

The aforementioned support mechanism is a vertical bar. The upper portion of that vertical bar is hinged on the folding leaf. The body of the vertical bar is restrained by a bar housing. The bar housing is hinged to the crossing hinged joint of the set of diagonal bars in the front facade. The vertical bar will fold when the supporting legs are folded. When the chair is opened and the supporting legs assume their positions, the lower portion of that vertical bar will reach the ground to provide a sturdy support for the front folding leaf of the seat.

There is a reinforced plastic part on the crossing hinge joint of the set of diagonal bars in the front vertical facade. That reinforced plastic part has an X cross-shaped hole that allows the two diagonal bars to pass through. The restraint housing of the vertical bar is hinged to the lateral front of the aforementioned reinforced plastic part.

The top of the aforementioned rear-tilting diagonal bar is secured with a V-shaped plastic part. That V-shaped plastic part allows it to receive and to be connected to the supporting bar.

The shape of the aforementioned seat frame is constructed in one of the following shape options: circle, oval, rectangle, triangle, pentagon, hexagon, octagon, trapezoid, gourd shape, or bread shape (i.e., with rounded corners in the front and square corners in the back).

This invention is a breakthrough from conventional designs. The seat is designed to be folded up. This design not only provides protection for the seat cushion fabric, but also prevents the fabric from exposing to the outside. It keeps the seat cushion clean during storage and transportation. It also saves extra packaging. The folding operation is smoother and simpler, since there is no need to turn the chair around. It can be folded by naturally lifting the strap on the supporting leg. Tying the strap to the seat bar forms a half-moon shape.

BRIEF DESCRIPTION OF THE DRAWINGS

Similar reference characters denote corresponding features consistently throughout the attached drawings. Namely, in the drawings the following reference numbers refer to the following part.

Figure 1:
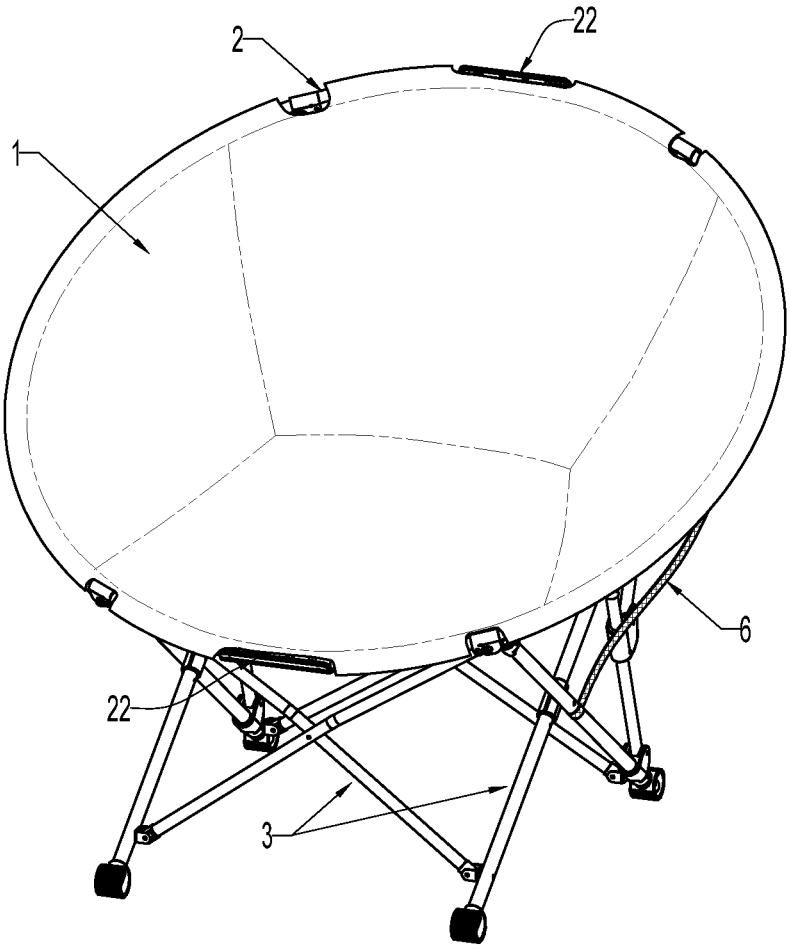
FIG. 1 is a 3D illustration of the upward folding chair.

1—upholstery fabric
2—seat frame
21—set bars
22—folding leaf
220—hinge groove
3—diagonal bar set
31—front-tilting diagonal bar
311—fixation column
32—rear-tilting diagonal bar
33—V-shaped plastic part
34—reinforced plastic part
4—connecting bar
41—slide housing
5—support bar
6—strap
7—knitted strap
8—vertical bar
81—bar casing

DETAILED DESCRIPTION OF THE PREFERRED EMBODIMENT(S)

In reference to FIG. 1 to FIG. 4, an upward folding chair in shown, including an upholstered seat cushion 1, seat 2, and supporting legs. The upholstered seat cushion is hung on the seat to provide support for the human body. Soft materials such as Oxford fabric or cotton may be used to create a seat back. Additionally, the seat back may be filled with a warming material for use during autumn and winter. Alternatively, the seat frame may be fitted with tight, stretchy fabric, such as elastic threads or elastic strings woven into a flat surface, so that it will naturally sink when the seat is loaded. Alternatively, a combination of stretchy fabric and elastic material may be use. All of these materials are able to provide support for the human body.

Seat 2 consists of the left and right halves, with corresponding or symmetrical seat bars 21. The seat is formed by joining the front and rear folding leaves 22. Both ends of the folding leaf 22 have an upward-facing hinge groove 220. Seat bar 21 is hinged into the hinge groove 220 so that the chair can only be folded upwardly.

The supporting leg has four facades. Each facade consists of a set of two diagonal bars which are crossed and connected in the center 3. The diagonal bars 3 of the front and rear facades are hinged to the diagonal bars 3 of the two adjacent facades.

The two adjacent facades of the supporting legs are symmetrical or at least correspond to each other, including the front-tilting diagonal bar 31 and the rear-tilting diagonal bar 32 in the diagonal bar pair, and the connecting bar 4 and supporting bar 5. The top of the front-tilting diagonal bar 31 is hinged to the front of the seat 2. There is a slide housing 41 on the bar below the hinged point. One end of the connecting bar 4 is hinged on the slide housing; the other end is hinged to the rear-tilting diagonal bar 32. This creates a support frame that folds at the same time the pair of diagonal bars 3 folds. One end of the aforementioned support bar 5 is hinged on connecting bar 4, the other end on the back of the seat. The supporting legs assume their proper positions when the chair is opened, and the top of the aforementioned rear-tilting diagonal bar 32 rests on the supporting bar 5 thereby forming a triangular supporting structure. The top of the rear-tilting diagonal bar 33 is securely capped with a V-shaped plastic part. The V-shaped plastic part 33 allows it to receive and be connected to the supporting bar 5, offering a more accurate alignment during the unfolding process. It also prevents sideways movement that could cause improper opening or accidental opening.

Figure 3:
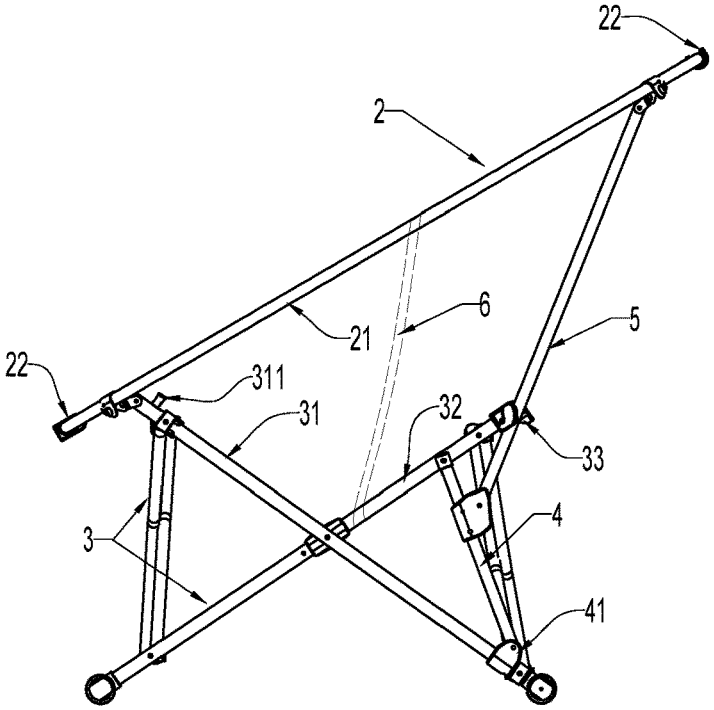
FIG. 3 is an illustration of the side view of the upward folding chair frame.
Figure 7:
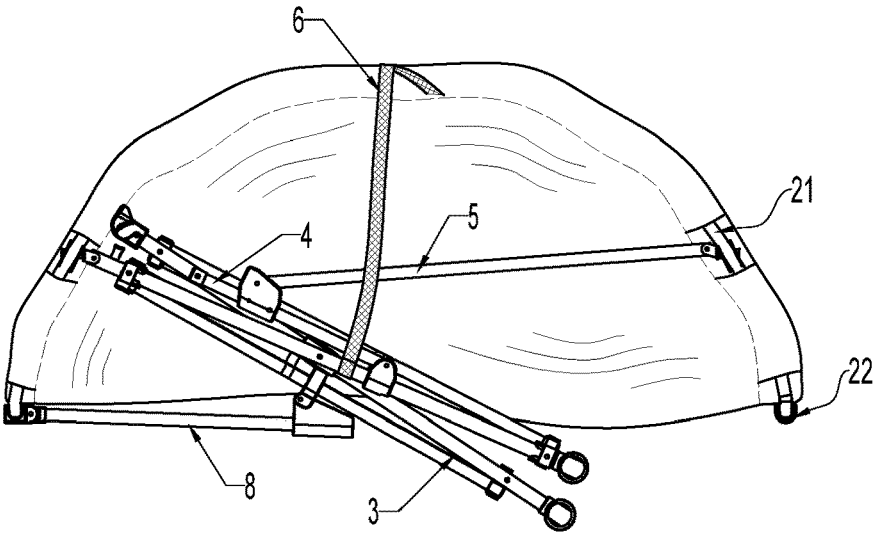
FIG. 7 is an illustration of the upward folding chair when it's folded.

When the seat is being folded upwardly, the supporting legs also fold up. Finally, by tying the connecting strap 6 and the seat bar 21 together, the structure of the folding position is formed. That means that the tying strap 6 is fixed on the diagonal bars 3 on both sides of the supporting leg, and more specifically, on the bar below the hinge joint. The other end can be secured on the seat 2 or on the upholstered seat cushion of the corresponding seat 1. The dotted lines in FIG. 1 and FIG. 3 illustrate the structure, which is in a tight condition when it is being unfolded. While usage and aesthetics are not affected, the straps on both sides may be lifted up naturally. This further pushes the supporting legs toward the seat bottom 2 so that the folded chair is more compact. After being pulled over the rear folding seat bar 21, the straps on both sides 6 may be secured in place with a lock, for instance with a buckle, and the strap 6 may be used as a carrying handle for portability. FIG. 7 illustrates the condition when opened. The supporting legs may be further folded upwardly, and both the left and the right sides are situated on the outside of the upholstered seat 1 providing protection and overall utility.

Since the two seat bars 21 of the seat 2 use an upward-folding method, and by contrast, the front and rear folding leaves 22 are downward, which is the same direction as gravity. Based on conventional thinking, after the human body sits on the seat, the seat 2 would appear to fold up automatically. But this is actually based on a misunderstanding of the invention. The restraint from the supporting legs, especially when forces are applied to the supporting legs will be unfolded outwardly. This creates an offset effect. As the frame is formed by bars hinged together, deformation of the bars and gaps between the hinge joints are inevitable. Deliberately pressing the front and rear of the folding leaf 22 will result in deformation of the seat 2, but does not affect normal use or the safety function of the folding chair. To minimize deformation, a stabilizing support structure is installed in the front of the supporting legs.

Figure 2:
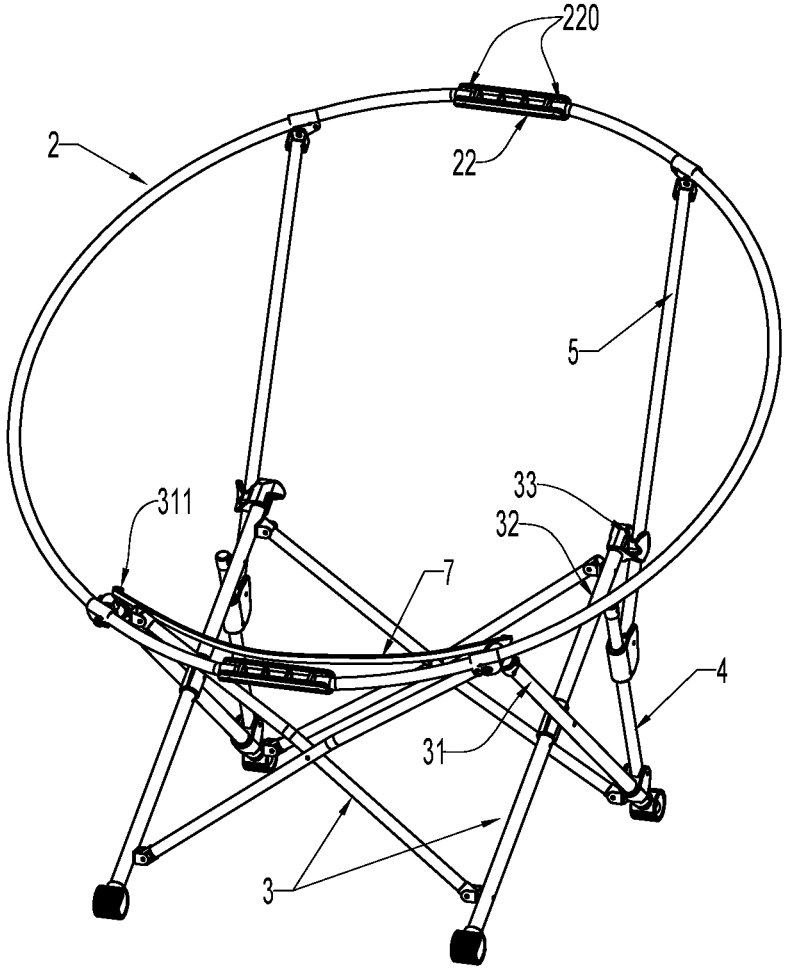
FIG. 2 is a 3D illustration of the upward folding chair's frame.
Figure 4:
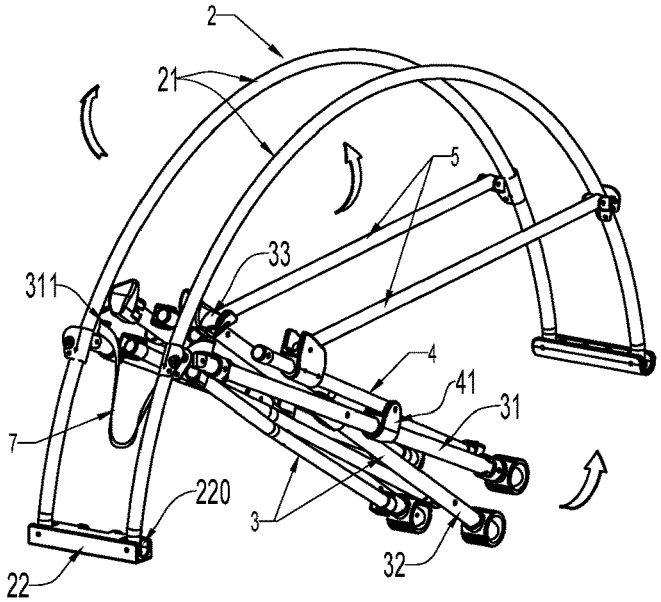
FIG. 4 is an illustration of the upward folding chair frame, folded.

As illustrated in FIG. 2 and FIG. 4, the stabilizing structure in this actual example is a knitted strap 7. Each end of the knitted strap 7 is securely tied to the top part of the two front-tilting bars 31. That is, the upper end of the front-tilting diagonal bar 31 is installed with an upward facing fixation post 311. The knitted strap 7 is fixed on that fixation post 311. Using that fixation post 311 allows the knitted strap 7 to be placed at the bottom of the upholstered seat cushion, so that when the seat cushion 1 is loaded, it is immediately supported by the knitted strap 7. This will reduce the incidence of inward-folding or overturning of the two seat bars 21 caused by the sinking of the upholstered seat cushion 1.

Figure 5:
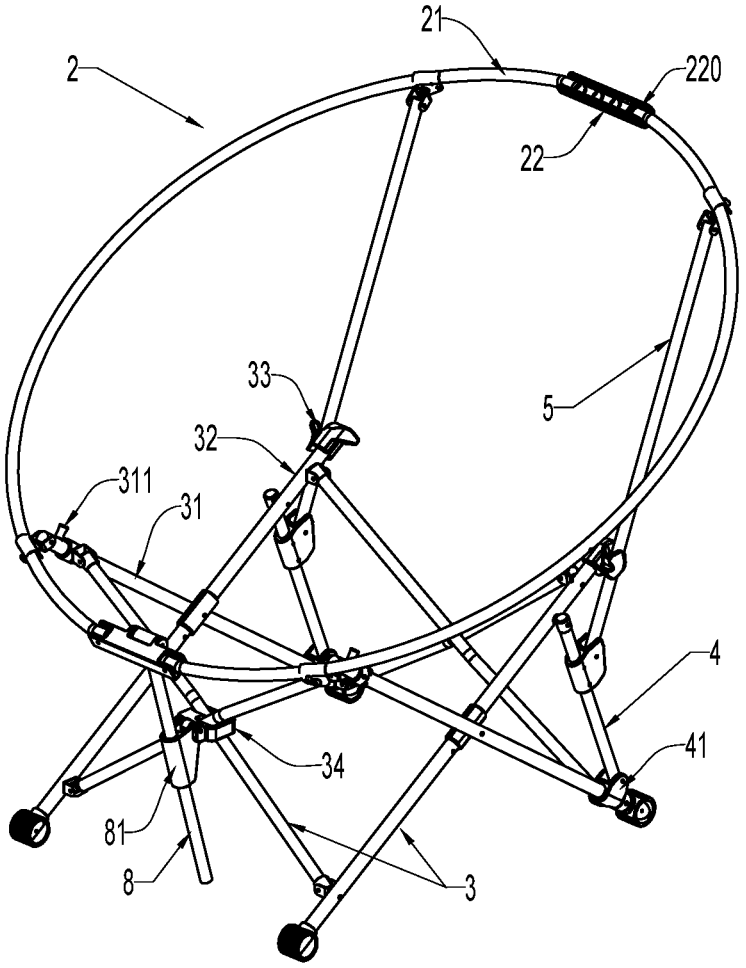
FIG. 5 is an illustration of the upward folding chair with supporting bars.
Figure 6:
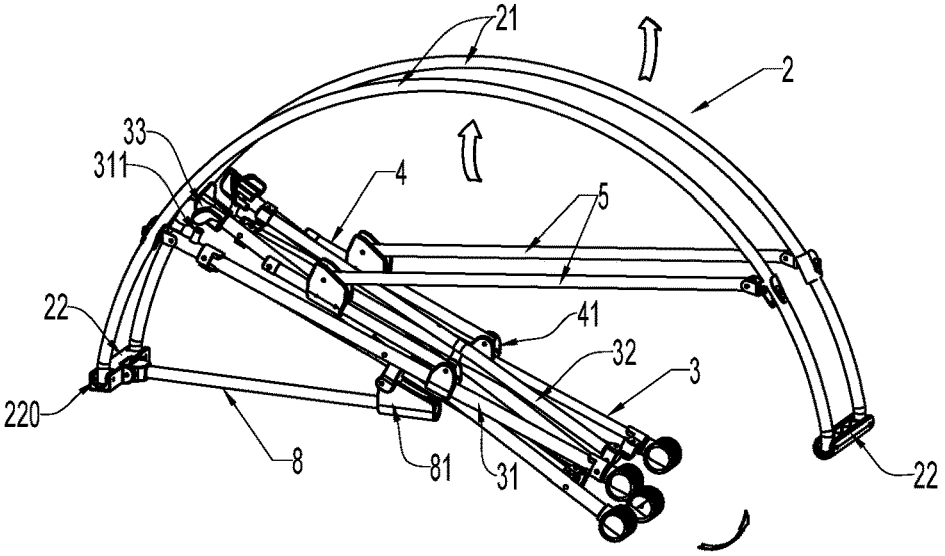
FIG. 6 is an illustration of the upward folding chair with supporting bars folded.

In FIG. 5 and FIG. 6, the main structure is the same as in the above example, except that the support structure refers to a vertical bar 8. The top of that vertical bar 8 is hinged to the folding leaf 22. The body of the bar is restrained by a set of bars 81. That set of bars 81 is hinged to the hinged crossing of the pair of diagonal bars 3 in the front. To be more specific, there is a reinforced plastic part 34 connected to the hinged crossing of the pair of diagonal bars 3 in the front. That reinforced plastic part has a hole shaped like an X cross that allows the two diagonal bars to pass through. The bar casing 81 of the restraining vertical bar 8 is hinged to the side of reinforced plastic part 34 in the front, so that the bar casing 81 can move freely without affecting the opening and folding function of the supporting legs. When the chair is opened and the supporting legs assume their positions, the bottom part of that vertical bar 8 will reach the ground, forming the sturdy support needed by front folding leaf 22 of the seat, so that the seat 2 can become more sturdy overall.

In the above examples, the seat can be in any one of the following structure or shape, such as: round, oval, rectangle, triangle, pentagon, hexagon, octagon, gourd shape, or bread shape, i.e., with rounded corners in the front and square corners in the back.

The following figures illustrate the different seat designs.

In FIG. 2, the seat 2 is in round shape. It is the basic design with the simplest manufacturing process. The design is classic. It includes the oval shape design. The following different designs may be produced based on this basic design.

Figure 8:
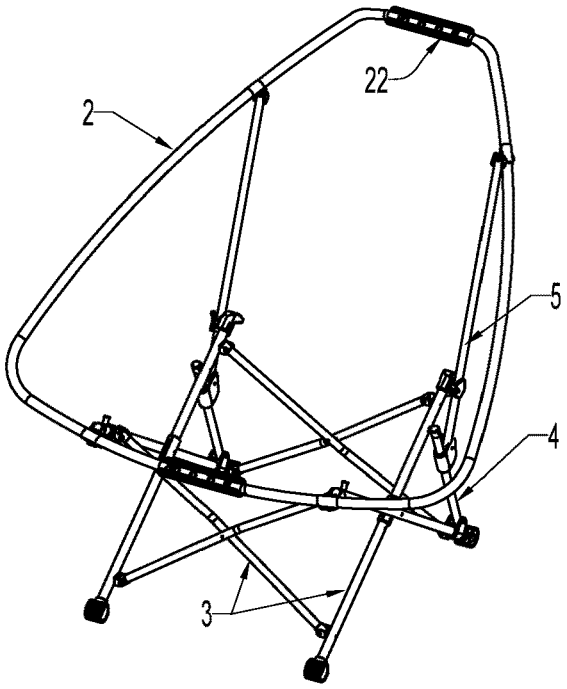
FIG. 8 is an illustration of the folding chair frame with a triangular seat frame.

In FIG. 8, the seat 2 is triangular.

Figure 9:
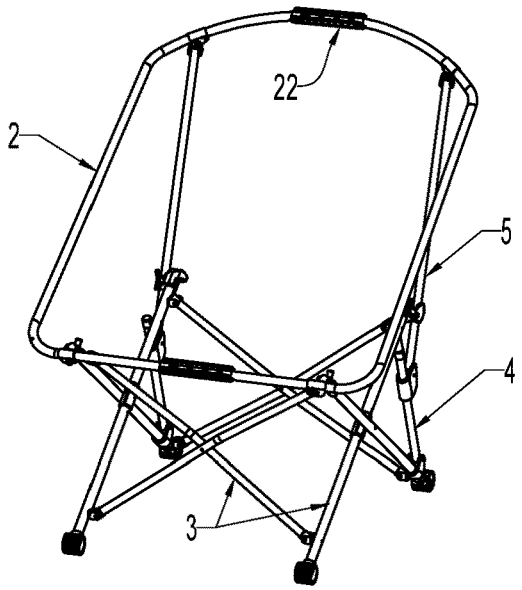
FIG. 9 is an illustration of the folding chair frame with a bread-shaped seat.

In FIG. 9, the seat 2 is in a bread shape. The shape has a rounded front and a square back.

Figure 10:
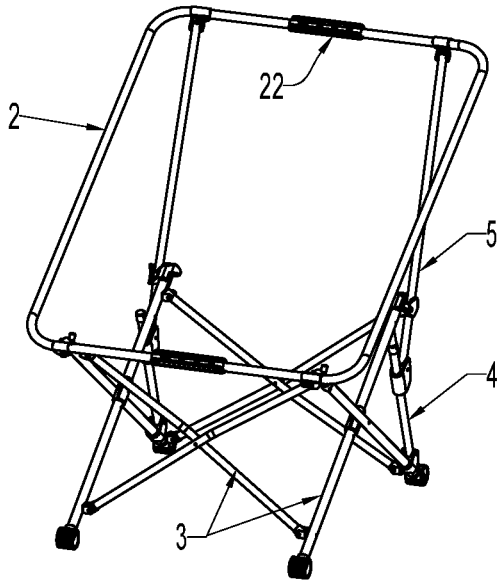
FIG. 10 is an illustration of the folding chair frame with a rectangular seat frame.

In FIG. 10, the seat 2 is rectangular. It may be a rectangle shape as illustrated, or it may be a square shape.

Figure 11:
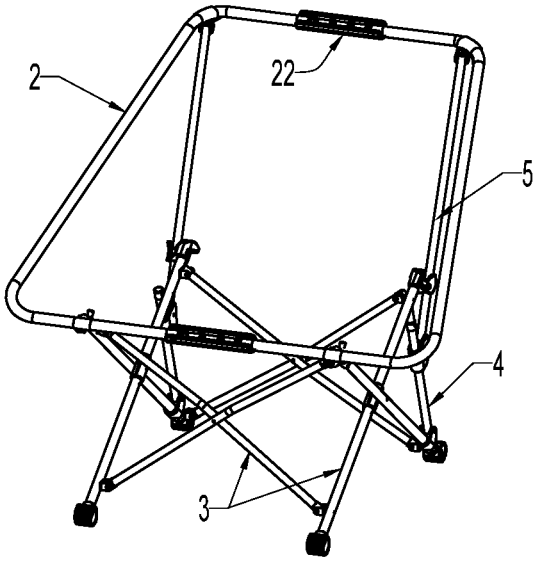
FIG. 11 is an illustration of the folding chair frame with a trapezoid seat.

In FIG. 11, the seat 2 is a trapezoid. The upper part of the trapezoid may be narrowed to offer an alternate shape.

Figure 12:
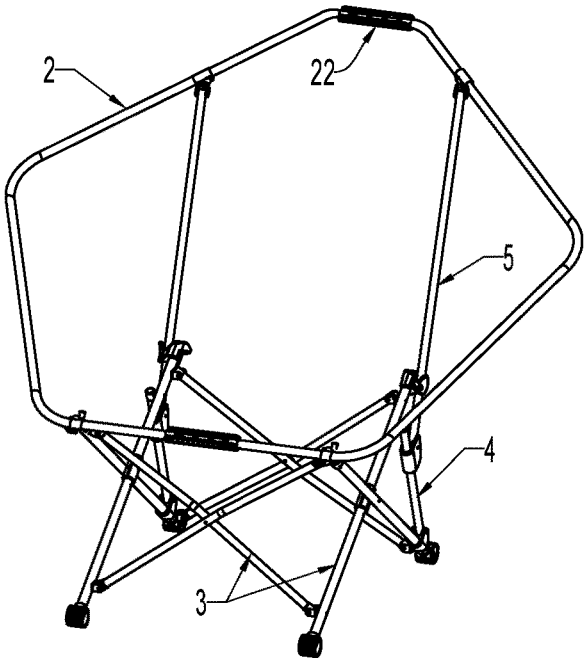
FIG. 12 is an illustration of the folding chair frame with a pentagonal seat frame.

In FIG. 12, the seat 2 is pentagonal.

Figure 13:
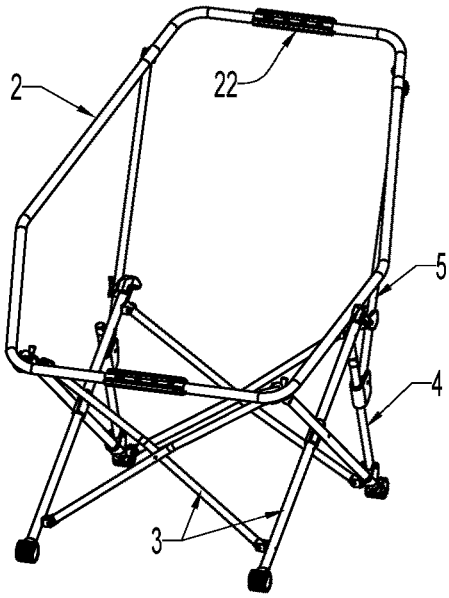
FIG. 13 is an illustration of the folding chair frame with a hexagonal seat.

In FIG. 13, the seat 2 is a hexagon.

Figure 14:
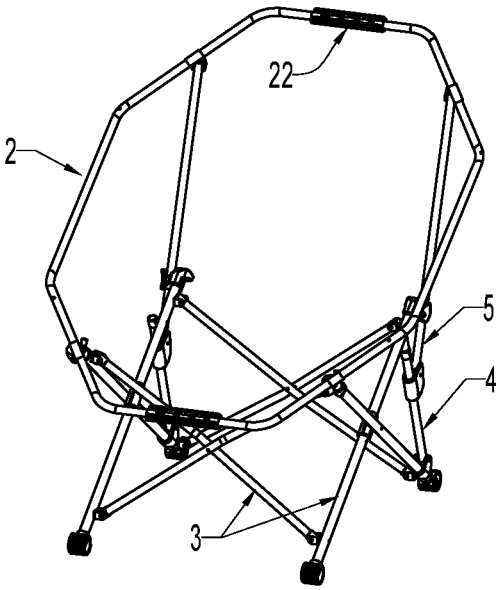
FIG. 14 is an illustration of the folding chair frame with an octagonal seat frame.

In FIG. 14, the seat 2 is an octagon. This shows that the seat 2 can be changed from a triangle to a polygon. It may be changed according design needs to produce versatile designs to meet everyday and aesthetic needs.

Figure 15:
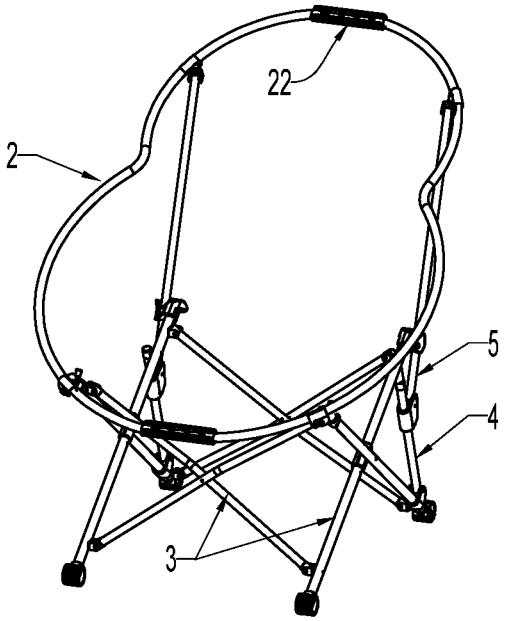
FIG. 15 is an illustration of the folding chair frame with a gourd-shaped seat.

In FIG. 15, the seat 2 is shaped like a gourd. This shape may be adapted to other fruits of similar shapes.

We claim:

1. An upwardly folding chair, comprising:

an upholstered seat cushion, a seat, and supporting legs;

the upholstered seat cushion is hung on the seat to provide support for a human body;

the supporting leg consists of four facades, including a front and rear façade;

wherein each facade consists of a set of two diagonal bars that are crossed and connected in the center;

two adjacent facades of the supporting leg include a front-tilting diagonal bar and a rear-tilting diagonal bar, and a plurality of connecting bars and supporting bars;

the diagonal bars of the front and rear facades are hinged by a hinged joint to the diagonal bars of the two adjacent facades;

the top of the front-tilted diagonal bar is hinged to a front of the seat;

a bar below the hinged joint is fitted with a slide housing;

one end of a one of the connecting bars is hinged on the slide housing; another end of the one connecting bar is hinged to the rear-tilting diagonal bar;

one end of the supporting bar is hinged to the connecting bar and the other end to the rear of the seat;

the supporting legs assume their positions when the chair is opened, and the top of the rear-tilting diagonal bar rests on the supporting bar;

the seat includes a left half and a right half and the seat bars, and is formed by joining the front folding leaf and the rear folding leaf;

the front and rear folding leaves each have an upward facing hinge groove on both ends;

the seat bars are affixed into the hinge groove so that the seat can only be folded upward;

wherein when the seat is being folded upward, the supporting legs also fold up; and, by tying a connecting strap 6 and the seat bar 21 together, the structure of the folding position is formed.

2. The upwardly folding chair of claim 1, wherein the two adjacent facades of the supporting leg are symmetrical to each other.

3. The upwardly folding chair of claim 1, wherein the front of the supporting leg is equipped with a stabilizing support mechanism.

4. The upwardly folding chair of claim 1, wherein the supporting mechanism is a knitted strap, and each end of the knitted strap is securely tied to the top part of the two front-tiling bars.

5. The upwardly folding chair of claim 4, wherein there is a fixation post on the upper end of the front-tilting diagonal bars, wherein the knitted strap is affixed to the front-tilting diagonal bars.

6. The upwardly folding chair of claim 5, further including a reinforced plastic part on the hinged joint of the set of diagonal bars in the frontal façade;

the reinforced plastic part has an X cross-shaped hole that allows the two diagonal bars to pass therethrough; and a restraint housing of the vertical bar is hinged to the lateral front of the reinforced plastic part.

7. The upwardly folding chair of claim 1, wherein the top of the rear-tilting diagonal bar is securely capped with a V-shaped plastic part, and the V-shaped plastic part provides support and is connected to the supporting bar.

8. The upwardly folding chair of claim 1, wherein the shape of the seat may be constructed in a shape selected from one of the following shapes: a circle, an oval, a rectangle, a triangle, a pentagon, a hexagon, an octagon, a trapezoid, a gourd shape, or a bread shape with a rounded front and a square rear.

* * * * *